US011659904B2

(12) United States Patent
Feldman et al.

(10) Patent No.: US 11,659,904 B2
(45) Date of Patent: May 30, 2023

(54) UMBRELLA WITH PET WASTE BAG DISPENSER

(71) Applicants: Sofia Feldman, New York, NY (US); Yianni Adam Feldman, New York, NY (US)

(72) Inventors: Sofia Feldman, New York, NY (US); Yianni Adam Feldman, New York, NY (US)

( * ) Notice: Subject to any disclaimer, the term of this patent is extended or adjusted under 35 U.S.C. 154(b) by 0 days.

(21) Appl. No.: 16/963,013

(22) PCT Filed: Sep. 18, 2018

(86) PCT No.: PCT/US2018/051410
§ 371 (c)(1),
(2) Date: Jul. 17, 2020

(87) PCT Pub. No.: WO2020/060535
PCT Pub. Date: Mar. 26, 2020

(65) Prior Publication Data

US 2020/0352291 A1 Nov. 12, 2020

(51) Int. Cl.
*A45B 9/02* (2006.01)
*B65H 35/00* (2006.01)
*A45B 9/00* (2006.01)

(52) U.S. Cl.
CPC ..... *A45B 9/02* (2013.01); *B65H 35/00* (2013.01); *A45B 2009/002* (2013.01); *A45B 2200/1054* (2013.01); *A45B 2200/1081* (2013.01); *B65H 2701/1842* (2013.01); *B65H 2701/191* (2013.01)

(58) Field of Classification Search
CPC ..... A45B 9/02; A45B 2009/002; A45B 2200/1054; A45B 2200/1081; B64H 35/00; B64H 2701/1842; B64H 2701/191
See application file for complete search history.

(56) References Cited

U.S. PATENT DOCUMENTS 1,859,627 A * 5/1932 Marsh ..... A45B 3/00 135/66
1,931,078 A 10/1933 McWilliams
2,044,251 A 6/1936 McWilliams
2,312,041 A 2/1943 Lillie
5,135,134 A * 8/1992 Dancy ..... B65H 35/002 221/155
5,167,377 A * 12/1992 Chalmers ..... A47F 13/085 119/161
5,441,017 A * 8/1995 Lindsay ..... A01K 27/003 119/161
6,223,695 B1 * 5/2001 Edwards ..... A01K 27/004 119/795

(Continued)

*Primary Examiner* — N C Hawk
(74) *Attorney, Agent, or Firm* — Dilworth & Barrese, LLP

(57) ABSTRACT

An umbrella having a pet waste bag dispenser is provided. The umbrella includes a canopy mounted to a post, a handle at a lower end of the post. The handle has a first end attached to the post and a second end having a cap member which is a removably attachable on an open bottom of the second end. The handle further defines a cavity therein and an opening formed on a side of the handle. The plurality of bags are in a rolled-up configuration and positionable within the cavity. Each bag of the bag module is accessible through the opening when the bag module is positioned within the cavity.

12 Claims, 3 Drawing Sheets

(56) References Cited

U.S. PATENT DOCUMENTS

| | | | | |
|---|---|---|---|---|
| 7,861,354 | B1 * | 1/2011 | Williams | A01D 7/00 15/105 |
| 7,992,753 | B2 * | 8/2011 | Edwards | B65H 35/10 225/106 |
| 8,714,428 | B2 * | 5/2014 | Mallard | B65D 83/0841 225/58 |
| 9,655,415 | B2 | 5/2017 | Feldman et al. | |
| 10,159,390 | B2 * | 12/2018 | Wilcox | B65H 75/16 |
| 2006/0118569 | A1 | 6/2006 | Edwards | |
| 2006/0118588 | A1 * | 6/2006 | Edwards | B65H 35/10 225/6 |
| 2007/0204805 | A1 | 9/2007 | Brody | |
| 2007/0267531 | A1 * | 11/2007 | Petersen | B65D 83/0805 242/588.6 |
| 2011/0232031 | A1 * | 9/2011 | Salais | A01K 27/006 16/111.1 |
| 2015/0001332 | A1 * | 1/2015 | Qin | B65H 16/005 242/598.3 |
| 2016/0194139 | A1 * | 7/2016 | Beaton | B65D 83/0481 222/173 |
| 2017/0370056 | A1 * | 12/2017 | McDonald | B65F 1/002 |

* cited by examiner

UMBRELLA WITH PET WASTE BAG DISPENSER

TECHNICAL FIELD

The present disclosure relates to an umbrella with a pet waste bag disperser, and more particularly to a pet waste bag dispenser deployed in a handle of an umbrella.

BACKGROUND

It is known in the art to modify conventional umbrellas for various purposes. For example, U.S. Pat. No. 5,111,835 discloses a folding umbrella having a water collecting handle and a sheath such that water on a rain dampened umbrella drips into the water collecting handle. In addition, U.S. Pat. No. 8,297,295 is directed to a multi-fold umbrella combined with a writing implement or cosmetic case such that the umbrella can be stored in its own handle. U.S. Pat. No. 5,441,064 is also directed to a combination of an umbrella and a rain cover storage system and discloses an umbrella having pockets for storing leggings. U.S. Pat. No. 7,581,555 is directed to an umbrella with a compartment adapted to hold a planar sheet of material for covering an individual's back. Most recently, U.S. Pat. No. 9,655,415 is directed to a rain protection system with an umbrella and a stored rain gear.

Pet owners often have to walk dogs in a park. It is good manners and often required by law to clean up dog waste after the dogs, which is often much trouble, particularly on a rainy day since the pet owners may also be carrying an umbrella.

Thus, there is a need for an apparatus or device allowing us to carry pet waste bags with an umbrella and dispense them with ease even on a rainy day.

SUMMARY

In one aspect of the present disclosure, there is provided an umbrella including a canopy mounted to a post, a handle at a lower end of the post, and a bag module having a plurality of bags. The handle includes a first end attached to the post and a second end having a cap member which is a removably attachable on an open bottom of the second end. The handle further defines a cavity therein and an opening formed on a side of the handle. The plurality of bags are in a rolled-up configuration and positionable within the cavity. Each bag of the bag module is accessible through the opening when the bag module is positioned within the cavity.

In another aspect of the present disclosure, there is provided a bag dispensing system deployed with an umbrella. The bag dispensing system includes a container, an opening forded on a side of the handle for exposing a portion of the container to outside and dispensing each of a plurality of bags, and a cap member. The container is provided in a hollow cavity of a handle of the umbrella for storing a bag module having the plurality of bags. The cap member is removably attachable on an open bottom end of the handle.

In still other aspect of the present disclosure, there is a bag module storing in a casing. The bag module includes a plurality of bags in a rolled-up configuration and positionable within a hollow cavity of a umbrella handle.

In some embodiments, the cap member includes a supporting member provided along with an axial direction of the cap member, and a structure of the supporting member is adapted to mate with a corresponding structure of the bag module to support and hold the bag module.

In some embodiments, the supporting member protrudes from an inner surface of a bottom end of a base of the cap member toward an open top end of the base.

In some embodiments, the umbrella further includes the bag module. The bag module has a ring post with a hollow cavity, and a portion of the protrusion of the supporting member is coupled to the hollow cavity of the ring post of the bag module.

In some embodiments, the bag module is stored in a casing made of a tearable material.

In some embodiments, the handle further includes: a cover configured to be closed or open by a user to prevent the opening of the handle from being exposed, upon the cover being closed.

In some embodiments, the plurality of bags comprise one or more pet waste bags.

In some embodiments, the supporting member has a sectional shape selected from a group consisting of: a circular shape, a cross shape and a quadrilateral shape.

In some embodiments, the base includes a thread formed along a perimeter of a surface of the base to be adapted to mate with a corresponding thread formed on a surface of the cavity of the handle.

In some embodiments, the casing is made of a thin polymeric plastic material.

In some embodiments, the casing is made of a transparent material.

BRIEF DESCRIPTION OF THE DRAWINGS

The figures depict embodiments for purposes of illustration only. One skilled in the art will readily recognize from the following description that alternative embodiments of the structures illustrated herein may be employed without departing from the principles described herein, wherein.

DETAILED DESCRIPTION

The following description and drawings are illustrative and are not to be construed as limiting. Numerous specific details are described to provide a thorough understanding of the disclosure. However, in certain instances, well known or conventional details are not described in order to avoid obscuring the description.

Reference in this specification to "one embodiment," "some embodiments" or the like means that a particular feature, structure, characteristic, advantage or benefit described in connection with the embodiment may be included in at least one embodiment of the disclosure, but may not be exhibited by other embodiments. The appearances of the phrase "in one embodiment" in various places in the specification are not necessarily all referring to the same embodiment, nor are separate or alternative embodiments mutually exclusive of other embodiments. Similarly, various requirements are described which may be requirements for some embodiments but not for other embodiments. The specification and drawings are to be regarded in an illustrative sense rather than a restrictive sense. Various modifications may be made thereto without departing from the spirit and scope as set forth in the claims.

The term "bag(s)" used herein may refer to any type of bags which are disposable such as plastic bags, dog waste bags, or the like. Similarly, the term "bag module" used herein may refer to a roll of such bag(s), as defined above. Optionally, the bag module may further contain a casing (e.g., casing) for housing the bag(s).

Figure 1:
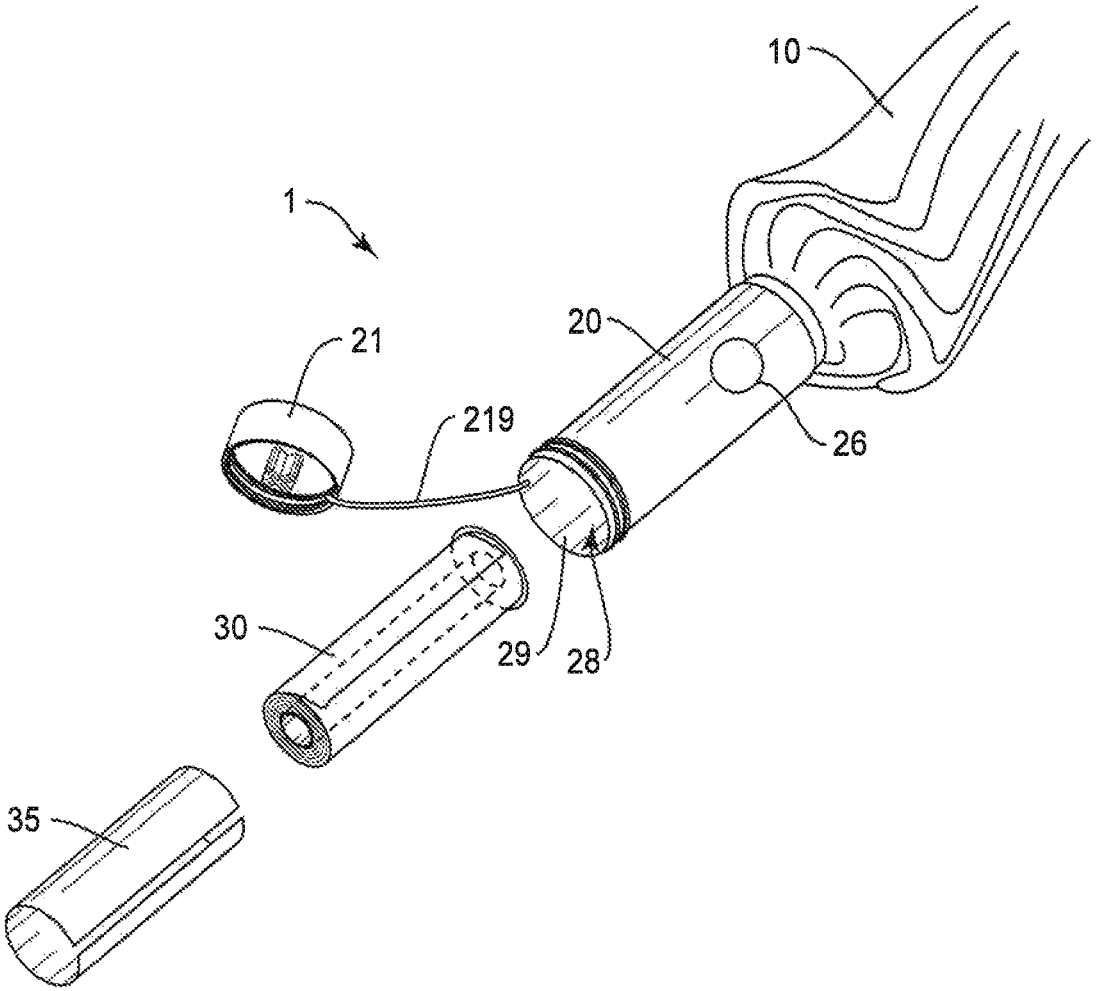
FIG. 1 is an exploded perspective view of an example umbrella with a dog waste bag dispenser according to an embodiment of the present disclosure.

Referring now to FIG. 1, the present disclosure describes an umbrella 1 having a dog waste dispenser deployed therein.

More particularly, the umbrella 1 can be for example, any type of typically used umbrella such as a traditional umbrella (i.e., a stick umbrella optionally with a telescopic shaft or post), pop-up or collapsible folding umbrella such as those which may fit into a handbag or carry case. The umbrella 1 includes an openable canopy 10 mounted to a post 50 (see FIG. 3). The hollow handle 20 at the bottom end of the post 50 is preferably cylindrical in shape and has a top wall, sidewall(s) and an open bottom so as to define axial hollow inner cavity 28 having sufficient space for storing one or more dog waste bag modules 30. Each dog waste bag module 30 may be provided to have at least one roll of dog waste bags.

The hollow handle 20 may alternatively have an oval or polygonal cross section. The handle 20 can be fabricated from any material suitable for the use described herein such as, for example a rigid plastic material.

Figure 2:
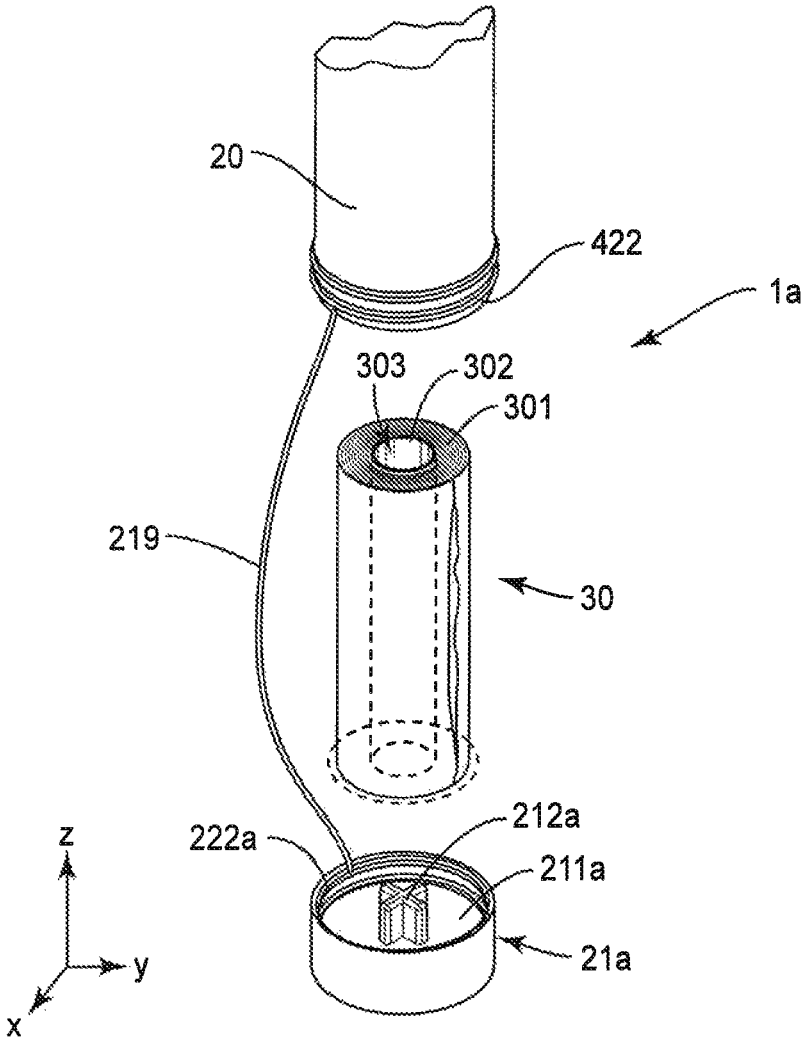
FIG. 2 is an exploded perspective view of an example umbrella showing a coupling of a dog waste bag module with a cap at a bottom end of the umbrella according to an embodiment of the present disclosure.

Referring now to FIG. 1, the handle 20 includes a cap member 21 which is adapted to close an open bottom portion 29 of the handle 20. In one aspect, the cap member 21 may be attached to the bottom portion 29 of the handle 20 by any suitable manner to prevent loss of the cap member 21, and preferably by an optional flexible loop 219 such as, for example, a cord fabricated from a polymeric material, such as nylon, or other suitable material. The cap member 21 can be constructed so as to attach to the open bottom portion 29 of the handle 20 by screw engagement, snap-fit engagement, or any other suitable mechanisms. For example, as illustrated in FIG. 2, the cap member 21 can have a rim 220*a* thereon, which is threaded along the perimeter for screw engagement, or is resiliently flexible for snap-fit engagement (not shown). The loop 219 may help the cap member 21 to be connected to the handle 20 to prevent loss of the cap member 21. In one aspect, the loop 219 may be wrapped around a user's wrist to facilitate carrying and holding of the umbrella 1.

Referring further to FIG. 1, the handle 20 has an opening 26 formed on a side thereof through which a portion of the hallow inner cavity s exposed to outside, such that a bag can be dispensed through the opening 26 upon being pulled out by a user. The shape or size of the opening 26 is not limited to a circle, as illustrated in FIG. 1. For example, the opening 26 may have an, oval, quadrilateral, slit shape, or the like with any size appropriate for a bag being pulled out therethrough. In some aspects, the opening 26 can be sealed by a separate cover or cap member (not shown). The cover may be open to pull out a dog waste bag by a user, and closed when the dog waste bag is not used, so the opening 26 could be prevented from being exposed to outside.

In some embodiments, the dog waste bag module 30 may optionally be stored in a casing 35 before the bag module 30 is inserted into the hollow inner cavity 28, such that the dog waste bag module 30 can be secured without being unrolling. The casing 35 may be of a generally tubular (e.g., circular) configuration with one or both ends open. Prior to the bag module 30 being inserted into the hollow inner cavity 28, the casing 35 may be removed. In one aspect, the casing 35 may be fabricated from a tearable thin polymeric plastic material to make it easier to be removed from the bag module 30. In another aspect, the casing 35 may be fabricated from a transparent material to allow a user to visualize the bags contained therein and may also include indicia on a surface thereof such as a logo, text and the like.

Referring further to FIG. 1, the hollow inner cavity 28, the opening 26, the cap member 21 and the bag module 30 constitutes a dog waste bag dispenser. For example, the hollow inner cavity 28 may serve as a container of the dog waste bag dispenser.

Referring now to FIG. 2, illustrated is a perspective view of a portion of an example umbrella 1*a* showing a coupling of a dog waste bag module 30 with a cap member 21*a* at a bottom end of the umbrella 1*a* according to an embodiment of the present disclosure.

In some embodiments, the cap member 21*a* may be configured to include: a base 211*a* having a preferably cylindrical shape with a closed bottom end and an open top end; and a supporting member 212*a* formed on the bottom end (e.g., preferably at a center thereof) of the base 211*a*. The base 211*a* may further have a thread (or rim) 222*a* formed along the perimeter of an inner (or outer) surface of the base to be adapted to mate with a corresponding thread 422 formed on an outer (or inner) surface of the hollow inner cavity 28 of the handle 20, so that the cap member 21*a* can be coupled to the handle 20 of the umbrella 1*a*.

The supporting member 212*a* is provided along with an axial direction of the cap member 21*a* and is adapted to mate with a corresponding structure at the center of the bag module 30 so as to support or hold the bag module 30, thus preventing it from loosening or moving around.

In some embodiments, the supporting member 212*a* may be formed to protrude from the base 211*a* toward the handle 20 when the bag module 30 has a hollow cavity 303 at a center thereof, so that the protruding portion of the supporting member 212*a* is inserted into the hollow cavity 303 of the bag module 30. The hollow cavity 303 may be an inner cavity of a cylindrical ring post, and the plurality of dog waste bags 301 may be rolled around the post 302, as illustrated in FIG. 2. Alternatively, the bag module 30 may be provided without the post 302. In another aspect, the post of the bag module 30 may be a cylindrical post having no hollow cavity therein (not shown), in this case the supporting member of the base 211*a* may be formed to cave in a portion of the cap member 21*a* to be adapted to mate with the post having no hollow cavity.

In some embodiments, the length of the supporting member 212*a* in a z-axis direction may sufficiently be long to secure supporting or holding the bag module 30. The longest diameter of the supporting member 212*a* on a x-y plane may be smaller than or approximate to a diameter of the cylindrical post 302 to ensure that the coupling of the bag module 30 to the supporting member 212*a* is so tight that a dog waste bag is not pulled out well.

Although it is illustrated in FIG. 2 that the supporting member 212*a* has a cross shape, exemplary embodiments of the present disclosure are not limited thereto. For example, the sectional shape of the supporting member 212*a* may include a circle, oval, square shape, or the like.

In use, the cap member 21*a* may be uncapped to open the hollow inner cavity 28 of the handle 20, and the bag module 30 may be inserted into the hollow inner cavity 28. Prior to inserting the bag module 30 into the hollow inner cavity 28, the bottom end of the bag module 30 may be coupled to the supporting member 212*a* of the cap member 21*a* to ensure that the bag module 30 is securely mounted on the cap member 21*a*.

The dog waste bags and/or the casing 35 may be disposable so that each can be discarded after use. For example, a user may replace the dog waste bag module 30 by inserting a new refill module into the hollow inner cavity 28.

Figure 3:
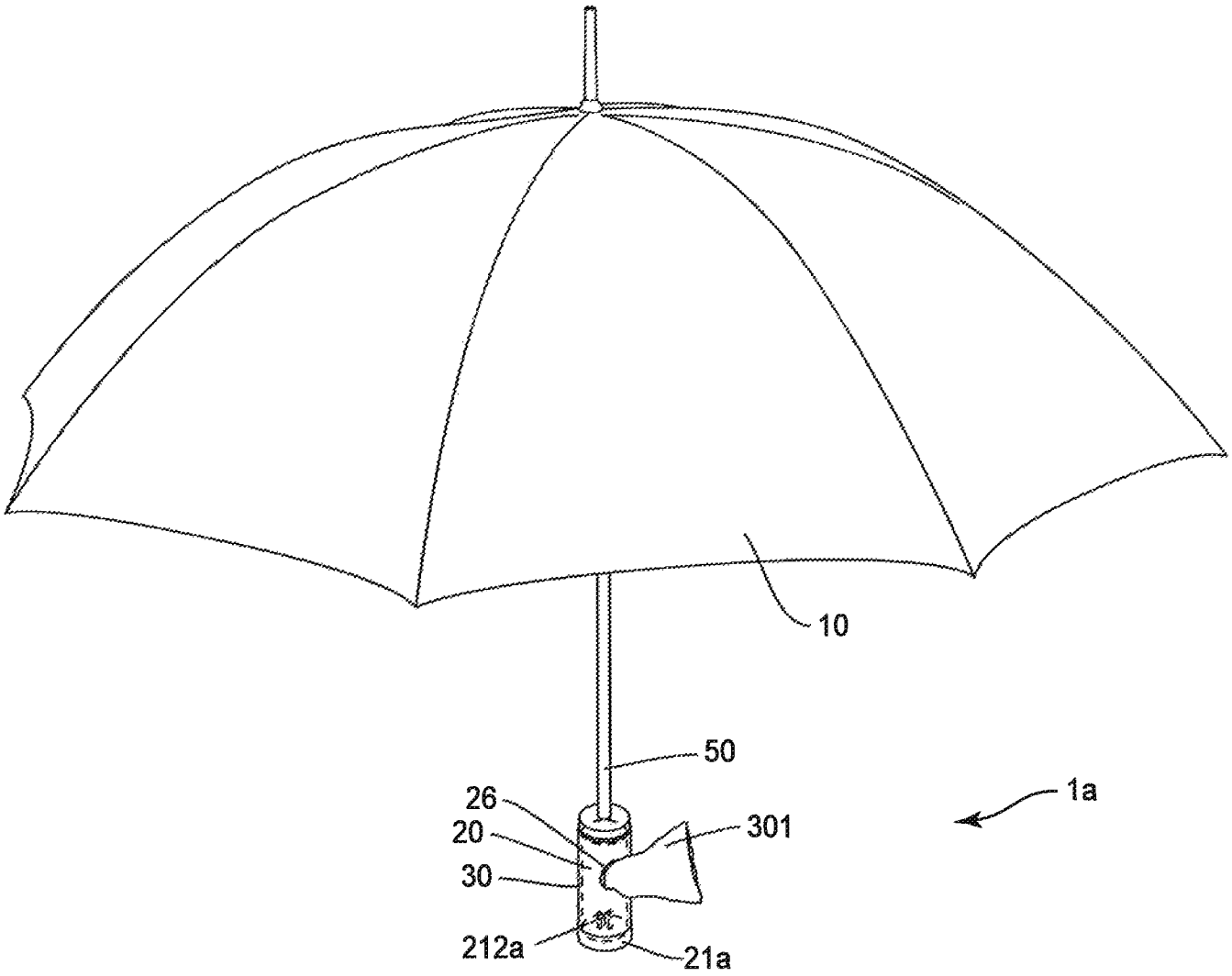
FIG. 3 is an exploded perspective view of an example umbrella illustrating a dog waste bag module being inserted to a handle of the umbrella according to an embodiment of the present disclosure.

Referring now to FIG. 3, illustrated is a perspective view of an example umbrella 1*a* showing a bag module 30 after the module 30 is inserted to the handle 20 of the umbrella 1*a* according to an embodiment of the present disclosure. It is illustrated in FIG. 3 that a dog waste bag 301 is being pulled out through the opening 26 of the handle 20.

It will be understood that various modifications can be made to the embodiments of the present disclosure herein without departing from the spirit and scope thereof. Therefore, the above description should not be construed as limiting the disclosure, but merely as embodiments thereof. Those skilled in the art will envision other modifications within the scope and spirit of the invention as defined by the claims appended hereto.

What is claimed is:

1. An umbrella, comprising:

a canopy mounted to a post;

a hollow, substantially cylindrical handle at a lower end of the post extending along an axis of the post, the handle having a first end attached to the post and a second end having a cap member which is a removably attachable on an open bottom of the second end, the handle defining a substantially cylindrical cavity therein and an opening formed through a circumferential side of the handle and into the cavity; and a bag module having a plurality of bags in a rolled-up configuration and positionable within the cavity, wherein each bag of the bag module is accessible through the opening when the bag module is positioned within the cavity, the cap member comprises a substantially cylindrical base, and a supporting member mounted upon and protruding from an inner surface of a bottom of the cap member, extending along the axis of the post and handle when the cap member is secured to the handle, and configured to mate with the bag module to support and hold the bag module, and the bag module having a ring-shaped post with a hollow cavity, such that a protruding end of the supporting member and an open end of the ring-shaped post of the bag module are configured to be coupled together, and bags can be dispensed through the circumferential opening of the handle while the canopy is open and held upright.

2. The umbrella of claim 1, wherein the bag module is stored in a casing made of a tearable material.

3. The umbrella of claim 1, wherein the handle further comprises:

a cover configured to be closed or open by a user to prevent the opening of the handle from being exposed, upon the cover being closed.

4. The umbrella of claim 1, wherein the plurality of bags comprise one or more pet waste bags.

5. The umbrella of claim 1, wherein the supporting member has a sectional shape selected from a group consisting of: a circular shape, a cross shape and a quadrilateral shape.

6. The umbrella of claim 1, wherein the base comprises a cylindrically-shaped perimeter extending upwardly from a bottom thereof and in a direction parallel to the extending direction of the supporting member, with a thread formed along an inner surface of the perimeter base and configured to mate with a corresponding thread formed on an outer circumferential surface of the handle.

7. The umbrella of claim 5, wherein the supporting member has a cross shape.

8. The umbrella of claim 1, wherein the ring-shaped post has opposite open ends.

9. The umbrella of claim 1, wherein said module, post and ring-shaped post of said module are all aligned along said axis.

10. The umbrella of claim 9, wherein said supporting member of said cap member is also aligned along said axis when the cap member is secured to said handle.

11. The umbrella of claim 10, wherein said ring-shaped post is positioned within said module such that the bags can be unrolled from within said module and removed through said circumferential opening, while the umbrella is open and upright.

12. The umbrella of claim 9, wherein said ring-shaped post is positioned within said module such that the bags can be unrolled from within said module and removed through said circumferential opening, while the umbrella is open and upright.

* * * * *